US007063547B2

(12) United States Patent
Toyoda et al.

(10) Patent No.: US 7,063,547 B2
(45) Date of Patent: Jun. 20, 2006

(54) CONNECTOR HAVING A MOVABLE MEMBER AND CONNECTOR ASSEMBLY

(75) Inventors: Yukihiro Toyoda, Yokkaichi (JP); Hideshi Tachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/036,626

(22) Filed: Jan. 14, 2005

(65) Prior Publication Data

US 2006/0030186 A1 Feb. 9, 2006

(30) Foreign Application Priority Data

Jan. 14, 2004 (JP) ..... 2004-006484

(51) Int. Cl.
*H01R 13/62* (2006.01)

(52) U.S. Cl. ..... 439/157; 439/372; 439/347

(58) Field of Classification Search ..... 439/157, 439/372, 347

See application file for complete search history.

(56) References Cited

U.S. PATENT DOCUMENTS 5,391,086 A * 2/1995 Woller et al. ..... 439/157
5,681,175 A * 10/1997 Busse et al. ..... 439/157
6,113,407 A 9/2000 Martin
6,168,445 B1 * 1/2001 Seutschniker et al. ..... 439/157
6,213,795 B1 * 4/2001 Drescher et al. ..... 439/157
6,217,354 B1 * 4/2001 Fencl et al. ..... 439/157
6,241,540 B1 6/2001 Tokuwa
6,305,957 B1 * 10/2001 Fink et al. ..... 439/157
6,345,995 B1 * 2/2002 Bigotto et al. ..... 439/157
6,641,423 B1 * 11/2003 Giro ..... 439/347
6,652,298 B1 * 11/2003 Ohnuki ..... 439/157
6,666,697 B1 * 12/2003 Yamashita ..... 439/157
6,702,597 B1 * 3/2004 Pade ..... 439/157
6,824,406 B1 * 11/2004 Sharples et al. ..... 439/157
6,890,194 B1 * 5/2005 Katsuma ..... 439/157
6,960,090 B1 * 11/2005 Denter et al. ..... 439/157
6,971,894 B1 * 12/2005 Dillon et al. ..... 439/157
2002/0072261 A1 * 6/2002 Pade ..... 439/157
2002/0081877 A1 * 6/2002 Ohnuki ..... 439/157
2003/0082940 A1 * 5/2003 Yamashita ..... 439/157
2003/0109155 A1 * 6/2003 Yamashita ..... 439/157
2005/0020114 A1 * 1/2005 Denter et al. ..... 439/157
2005/0064749 A1 * 3/2005 Stella et al. ..... 439/157
2005/0106911 A1 * 5/2005 Sharples et al. ..... 439/157

* cited by examiner

*Primary Examiner*—Ross Gushi
(74) *Attorney, Agent, or Firm*—Gerald E. Hespos; Anthony J. Casella

(57) ABSTRACT

A connector has a housing (20). A rotary lever (50) is mountable on shafts (45) of the housing (20) in either of two symmetric orientations selected in accordance with space restrictions and/or the orientation of a wire cover (30) on the housing (20). The rotary lever (50) has cam grooves (55) for engaging follower pins (15) on a mating housing (10). The housing (20) also has an insertion path (38) and a slide lever (60) is mountable in the insertion path (38) from either of two opposite directions selected in accordance with space restrictions. The slide lever (60) has cam grooves (63) for engaging the follower pins (15). The housing (20) has locks (41) for releasably holding the rotary lever (50) or the slide lever (60) at an initial position.

12 Claims, 18 Drawing Sheets

CONNECTOR HAVING A MOVABLE MEMBER AND CONNECTOR ASSEMBLY

BACKGROUND OF THE INVENTION

1. Field of the Invention

The invention relates to a lever-type connector.

2. Description of the Related Art

Large multi-contact connectors often use levers to assist in the development of the necessary connecting force. Lever-type connectors generally use either a rotary lever, as shown in U.S. Pat. No. 6,241,540 or a slide lever, as shown in U.S. Pat. No. 6,113,407.

A rotary lever connector has first and second housings and a lever supported rotatably on the first housing. The lever has cam groove that engages a cam follower pin on the second housing. The rotary lever is rotated to connect or separate the housings.

A slide lever connector has first and second housings and a slide lever mounted on the first housing for sliding movement along a direction intersecting the connecting direction of two housings. The slide lever has a cam groove that engages a follower pin on the second housing. The slide lever is moved forward and backward to connect and separate the housings.

The operation space for the lever of a lever-type connector often is restricted. Accordingly, lever-type connectors that have rotary and slide operating modes would be convenient because they could be used in accordance with operation spaces. However, this design has required a rotary lever, a slide lever and two kinds of housings in view of mounting constructions for the levers. Thus, there has been a demand for further improvements.

The present invention was developed in view of the above situation, and an object thereof is to improve versatility of a connector.

SUMMARY OF THE INVENTION

The invention relates to a connector with a housing that is connectable with a mating housing. The connector further includes at least one movable member formed with at least one cam groove. The movable member is mountable on the housing and is engageable with at least one follower pin on the mating housing. The two housings are connectable with and separable from each other by displacing the follower pin along the cam groove as the movable member is displaced. The movable member comprises a rotary lever and a slide lever each formed with the cam groove. The housing includes a shaft used to pivotably mount the rotary lever and an insertion path used to movably mount the slide lever forward and backward along a direction intersecting a connecting direction of the housing with the mating housing.

The rotary lever and the slide lever have different displacement modes. Therefore, the two housings can be connected efficiently by selecting a suitable lever operation. Further, production costs can be reduced because both levers are mountable on the same housing.

The rotary lever preferably is rotatably mountable in directions symmetrical with respect to the shaft. The slide lever preferably is mountable in symmetric postures from the opposite ends of the insertion path. Thus, four operation modes of the lever are available for selection.

The rotary lever and/or the slide lever preferably have engaging portions that can engage locks on the housing. Thus, the rotary lever and/or the slide lever can be locked temporarily at initial positions where an entrance of the cam groove substantially faces the follower pin. The locks preferably are used commonly for the respective engaging portions of the rotary lever and the slide lever. Additionally, the locks preferably are arranged symmetrically with respect to the shaft.

The connector further may comprises a wire cover that is mountable on the rear surface of the housing for accommodating wires drawn out from the housing and guiding the wires in a specified direction. The wire cover preferably is mountable in one of the symmetric positions. The wire draw-out direction can be selected by selecting the mounting direction of the wire cover.

The shaft for the rotary lever preferably is used as a locking means for locking the slide lever at an end position. Thus, the construction can be even simpler.

The slide lever comprises one or more guide grooves into which the shafts are fit during movement of the slide lever towards its end position.

Leading ends of the guide grooves preferably are formed into slanted guiding surfaces. The slanted guiding surfaces guide the shafts into the guide grooves as the slide lever is moved towards its end position.

The invention also relates to a connector assembly comprising the above-described connector and a mating connector connectable therewith.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector assembly according to the invention is illustrated in FIGS. 1 to 20. The assembly includes male and female housings 10 and 20 that are connectable along a connecting direction CD. In the following description, ends of the two housings 10, 20 to be connected with each other are referred as the front.

Figure 1:
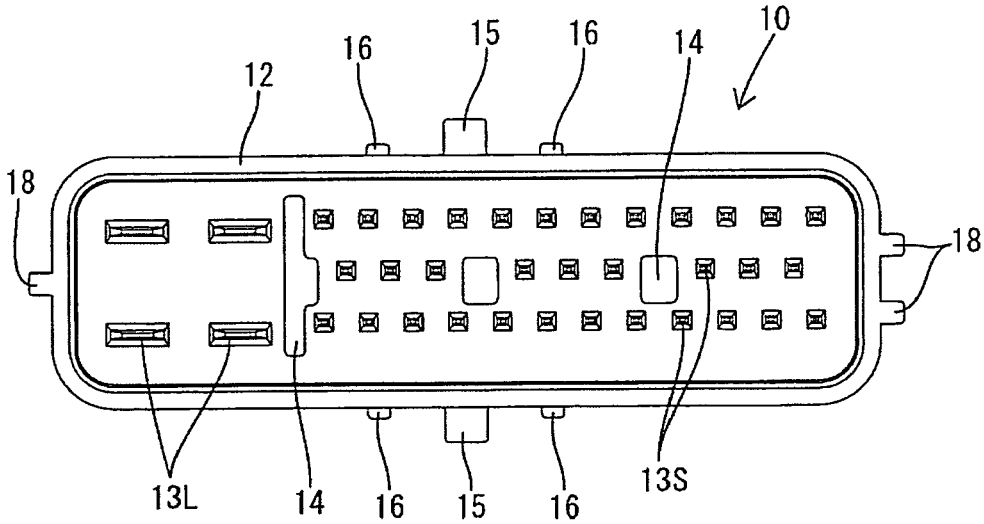
FIG. 1 is a front view of a male housing according to one embodiment of the invention.
Figure 2:
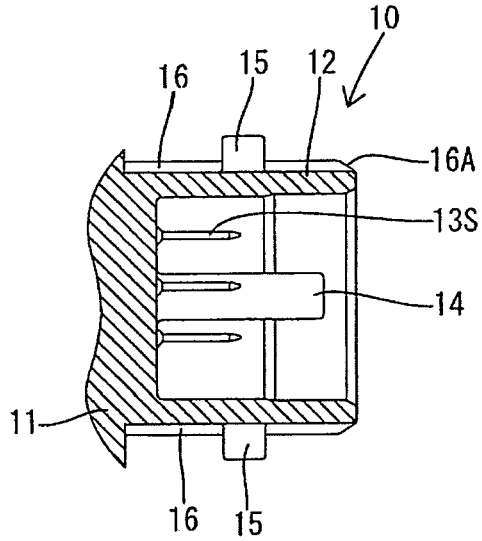
FIG. 2 is a vertical section of the male housing.
Figure 4:
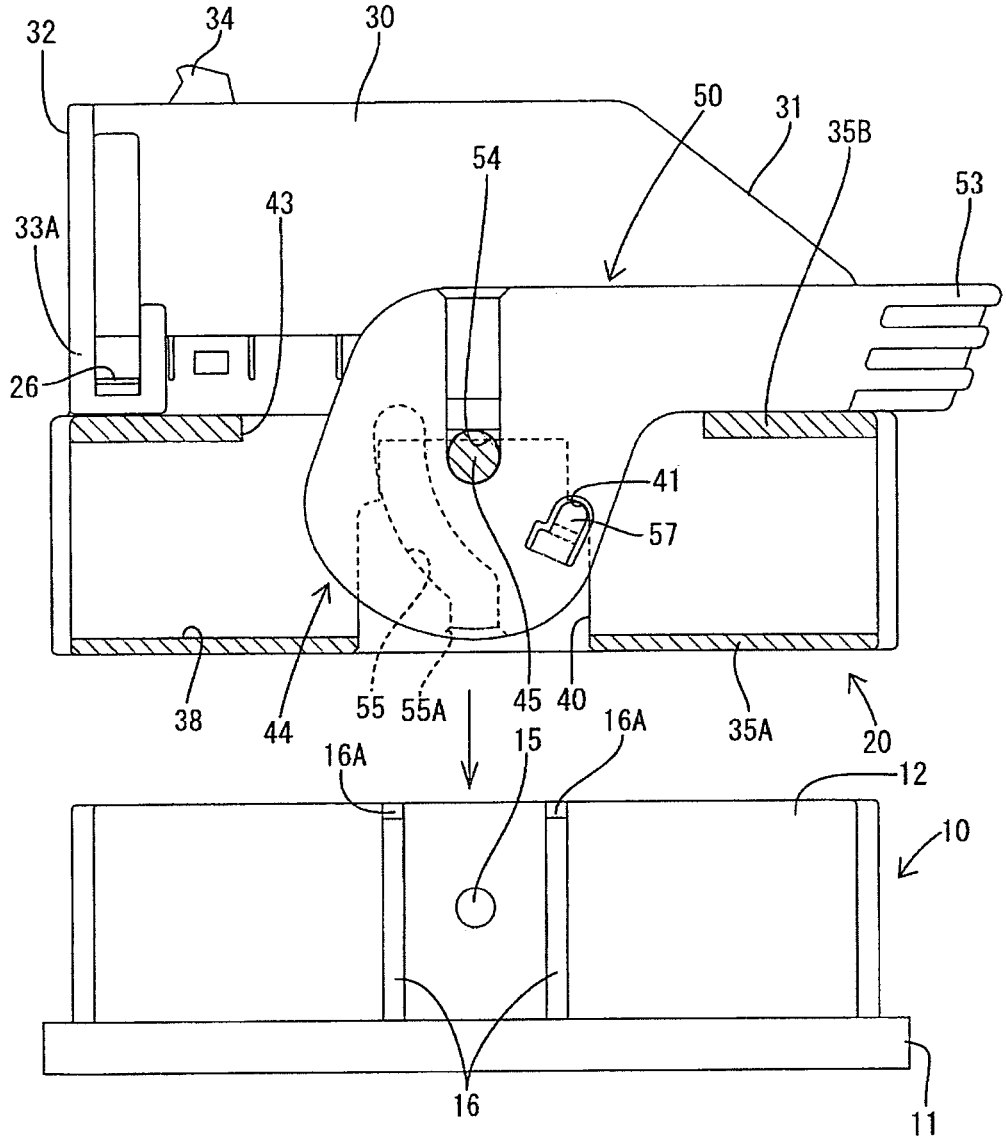
FIG. 4 is a plan view partly in section showing a state before the male and female housings are connected in the case of using a rotary lever.

The male housing 10 is made e.g. of a synthetic resin and includes a small receptacle 12 projecting unitarily from a wall of an apparatus 11, as shown in FIGS. 1, 2 and 4. The small receptacle 12 is wide in front view. Four large male terminals 13L project in a grid arrangement from a left area of the back surface of the small receptacle 12, and small male terminals 13S project at each of upper, middle and lower stages in a remaining area of the back surface of the small receptacle 12. Ribs 14 also project in the receptacle 12.

Two follower pins 15 project symmetrically in widthwise and longitudinal middle positions of the upper and lower surfaces of the small receptacle 12. Unlocking ribs 16 are formed symmetrically at left and right sides of each follower pin 15 and extend from the front to the rear. Each unlocking rib 16 has a slanted front surface 16A that slopes down towards the front.

One rib 18 is formed on the left side surface of the small receptacle 12 and two ribs 18 are provided on the right side surface of the small receptacle 12 when viewed from the front. The unequal number of ribs 18 on the respective sides prevents an upside-down connection of the male and female housings 10 and 20.

Figure 5:
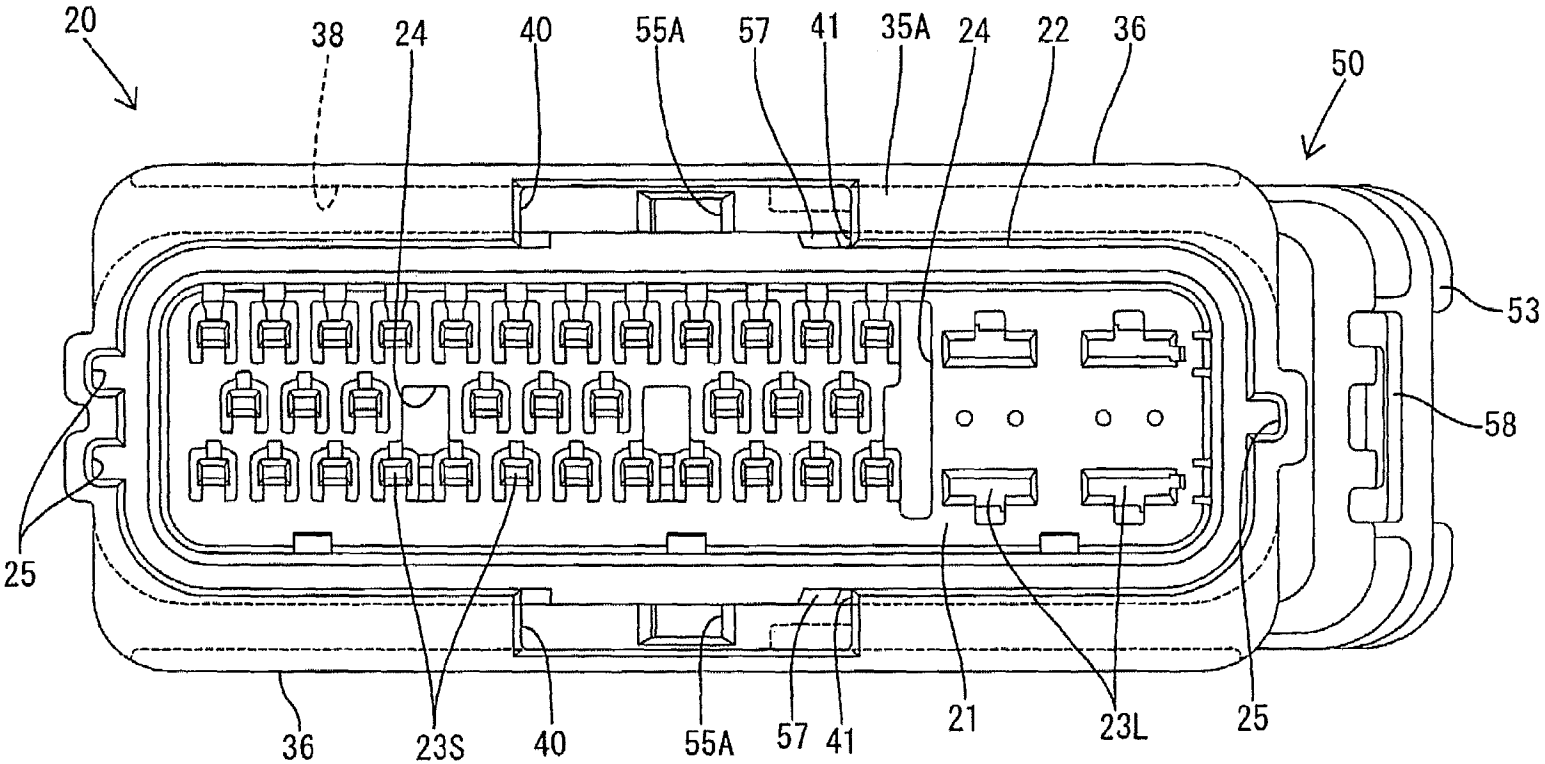
FIG. 5 is a front view of the female housing showing a state where the rotary lever is mounted at an initial position.

The female housing 20 is made e.g. of a synthetic resin and includes a flat tower 21 that fits into the small receptacle 12 of the male housing 10. A large receptacle 22 is formed around the tower 21 and fits on the small receptacle 12, as shown in FIG. 5.

Four larger cavities 23L are formed in a grid arrangement in a right area of the tower 21 when viewed from the front and face the large terminals 13L of the male housing 10. Small cavities 23S are formed at each of upper, middle and lower stages in a remaining area. Although not shown in detail, large female terminals are secured to ends of thick wires and are inserted into the large cavities 23L. Similarly, small female terminals are secured to ends of thin wires and are inserted into the small cavities 23S.

Fitting grooves 24 are formed in the front surface of the tower 21 for receiving the ribs 14 of the male housing 10 and for preventing the forcible connection. Fitting grooves 25 are formed in the left and right inner surfaces of the larger receptacle 22 for receiving the ribs 18 of the male housing 10 and for preventing the upside-down connection.

A wire cover 30 is mountable on the rear side of the female housing 20. The wire cover 30 is made e.g. of a synthetic resin and is in the form of a box having openings in the front surface and in the left surface in FIG. 3. These two openings communicate with each other. An inclined or rounded escaping surface 31 is formed at a corner of the cover 30. The cover 30 has an open end 32 and two resilient locking legs 33A project from the bottom edges of the opposite side plates to face each other at the open end 32. A resilient locking leg 33B projects from the lateral bottom edge of the end plate at a side of the closed end surface.

Upper and lower protrusions 26 are formed at opposite left and right ends of the upper and lower outer surfaces of the rear end of the female housing 20. Further, at least one protrusion (not shown) is formed on each of the left and right shorter surfaces.

The wire cover 30 is mountable to cover the rear surface of the female housing 20, and is selectively mountable in a posture where the open end 32 faces to the left side (see FIG. 4) and in a posture where it faces to the right side (see FIG. 9) by engaging the resilient locking legs 33*a* with a pair of the protrusions 26 arranged either at the left or right side and engaging the resilient locking leg 33B with one protrusion at the opposite side. Accordingly, the wires drawn out through the rear of the female housing 20 are bundled and bent sideways substantially at right angles. The wires then are guided substantially to the left or right through the open end surface 32.

A wide rectangular front flange 35A is formed around the opening edge of the large receptacle 22 of the female housing 20, and a similarly configured rear flange 35B is formed around the back edge. Covers 36 bridge the projecting edges of the front flange 35A and the rear flange 35B and are spaced from the upper and lower surfaces of the large receptacle 22. Thus, insertion paths 38 are defined between the covers 36 and the upper and lower surfaces of the large receptacle 22. The insertion paths 38 are open in the left and right surfaces of the female housing 20, but are closed in the front and rear of the female housing 20.

Figure 3:
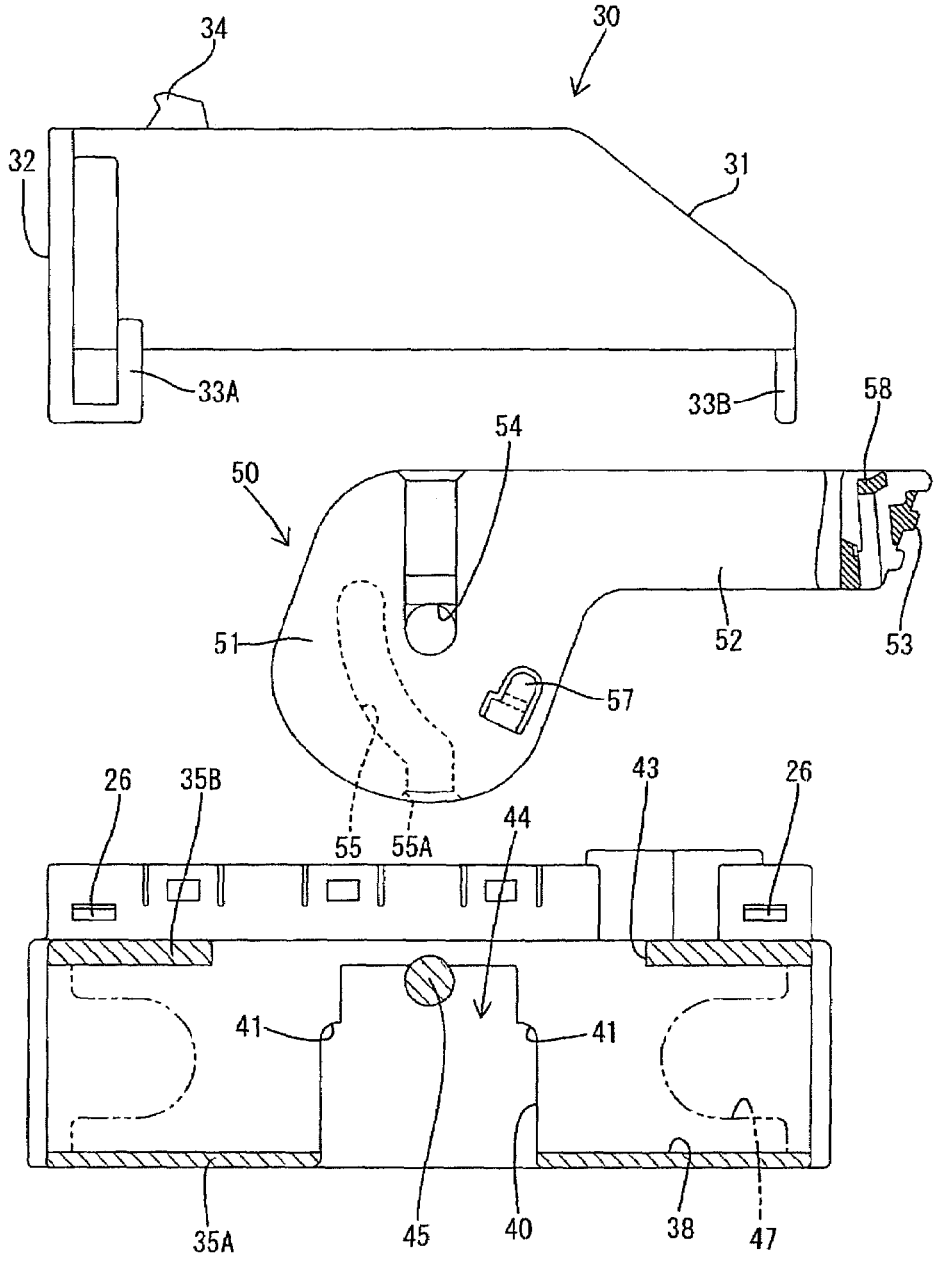
FIG. 3 is a plan view partly in section showing a state before a wire cover and a rotary lever are mounted on a female housing.
Figure 6:
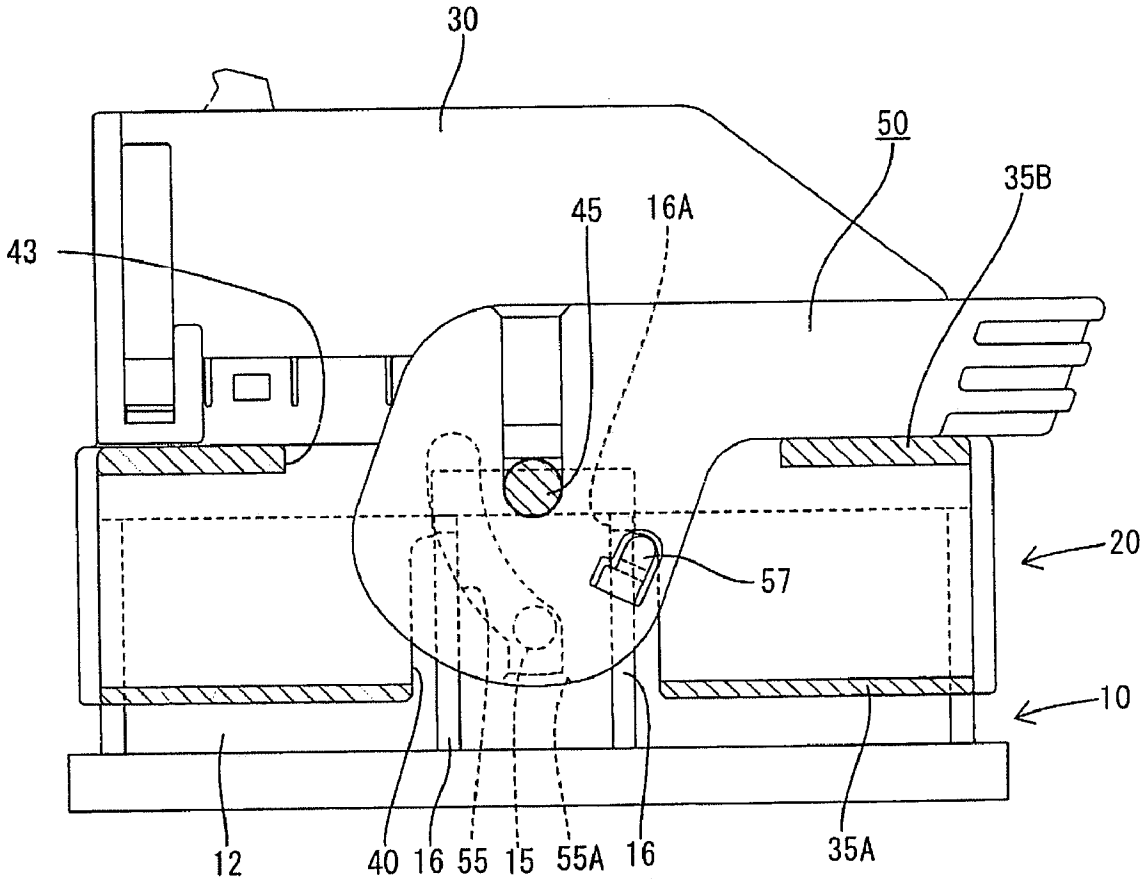
FIG. 6 is a plan view partly in section showing an initial stage of the connection of the male and female housings.
Figure 7:
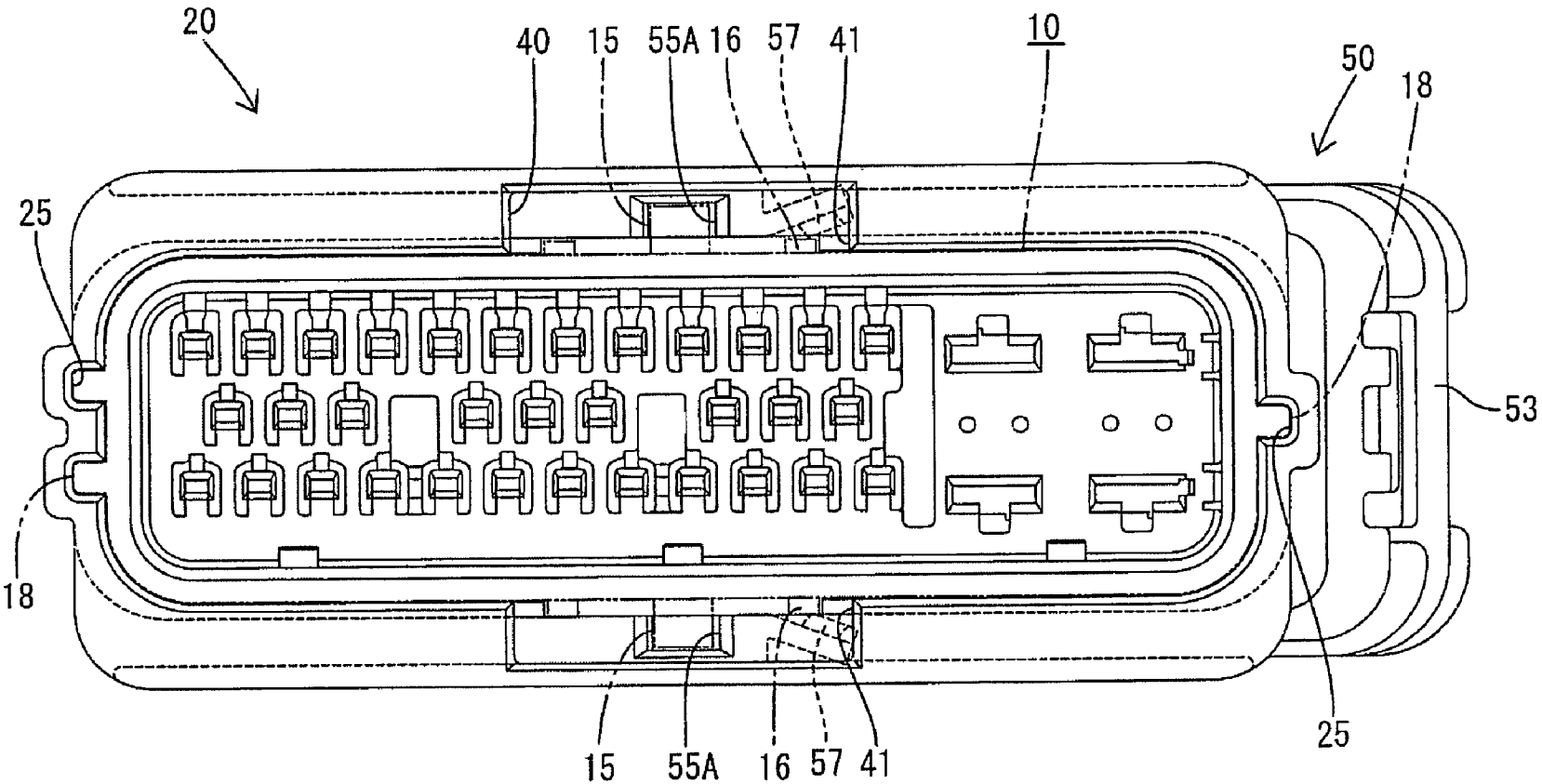
FIG. 7 is a front view of the female housing at the initial stage of the connection of the male and female housings.

Insertion grooves 40 are formed in the widthwise centers of the front edges of the upper and lower surfaces of the large receptacle 22 and the front flange 35A, as shown in FIG. 3. The insertion grooves 40 receive the follower pins 15 of the mating male housing 10 and the unlocking ribs 16 at the opposite sides of the follower pins 15. As shown in FIG. 6, a front portion of each insertion groove 40 is wider than the spacing between the two unlocking ribs 16. However, a portion of each insertion groove 40 slightly behind a middle position along depth direction is narrowed to a width that substantially equals the spacing between the two unlocking ribs 16. Thus, the insertion grooves 40 each have a stepped configuration, and a closed back end. A rounded lock 41 is defined at the step of each insertion groove 40.

Entrances 43 are formed at substantially widthwise middle portions of the upper and lower parts of the rear flange 35B, and are wider than the insertion grooves 40. Accommodation spaces 44 are defined inside the entrances 43 for accommodating drives 51 of the rotary lever 50. Shafts 45 project from the inner surfaces of the covers 36 at positions near the entrances 43 in the accommodation spaces 44.

The rotary lever 50 is made e.g. of a synthetic resin and has two substantially round drives 51. A coupling arm 52 projects from the outer periphery of each drive 51 and an operable portion 53 extends between the coupling arms 52, as shown in FIG. 3. Thus, the rotary lever 50 is substantially gate-shaped. A shaft hole 54 is formed substantially in the center of each drive 51 The drives 51 can be inserted through the entrances 43 and into the accommodation spaces 44 to hold the female housing 20 between the drives 51 and to engage the shaft holes 54 onto the shafts 45 that project in the accommodation space 44. The rotary lever 50 then is supported for rotation about the shafts 45 between an initial position LIP (see FIG. 4) and an end position LEP (see FIG. 8).

Cam grooves 55 are formed in the inwardly facing surfaces of the drives 51 of the rotary lever 50 and are engageable with the follower pins 15 of the male housing 10. Each cam groove 55 is curved around the shaft hole 54, and an entrance 55A of the cam groove 55 opens in the peripheral edge of the drive 51. The entrances 55A of the cam grooves 55 face forward and can receive the follower pins 15 when the rotary lever 50 is at the initial position LIP.

A locking piece 57 is provided on each drive 51 for temporarily locking the rotary lever 50 at the initial position LIP. The locking pieces 57 are substantially diametrically opposite the closed end of the cam groove 55. The leading ends of the locking pieces 57 are rounded to conform to the shape of the locking steps 41. The leading ends of the locking pieces 57 normally project more in than the inner surfaces of the drives 51. However, the locking pieces 57 are resiliently deformable and the leading ends can deflect outward.

The locking pieces 57 engage the corresponding locking steps 41 when the rotary lever 50 is at the initial position LIP, as shown in FIG. 4, to prevent rotation of the rotary lever 50 towards the end position LEP. Further, the locking pieces 57 are at positions on entrance paths for the unlocking ribs 16 on the mating male housing 10.

Figure 8:
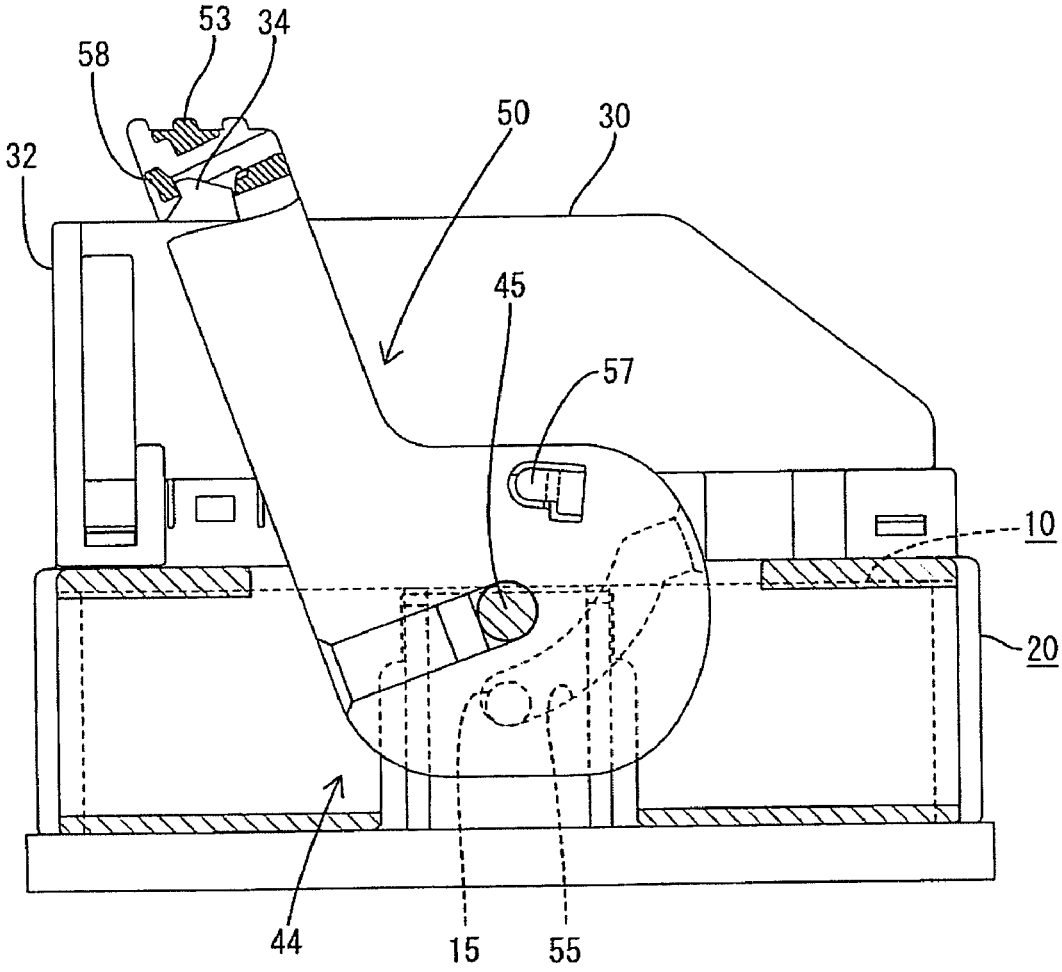
FIG. 8 is a plan view partly in section showing a state where the connection of the male and female housings is completed.

The rotary lever 50 can be rotated towards the end position LEP. However, the operable portion 53 contacts the upper surface of the wire cover 30 near the open end surface 32, as shown in FIG. 8, to limit the range of rotation. The operable portion 53 has a resiliently deformable lock 58 and a lock projection 34 is formed on the upper surface of the wire cover 30 near the open end surface 32. The lock 58 engages the lock projection 34 to hold the rotary lever 50 at the end position LEP.

Figure 11:
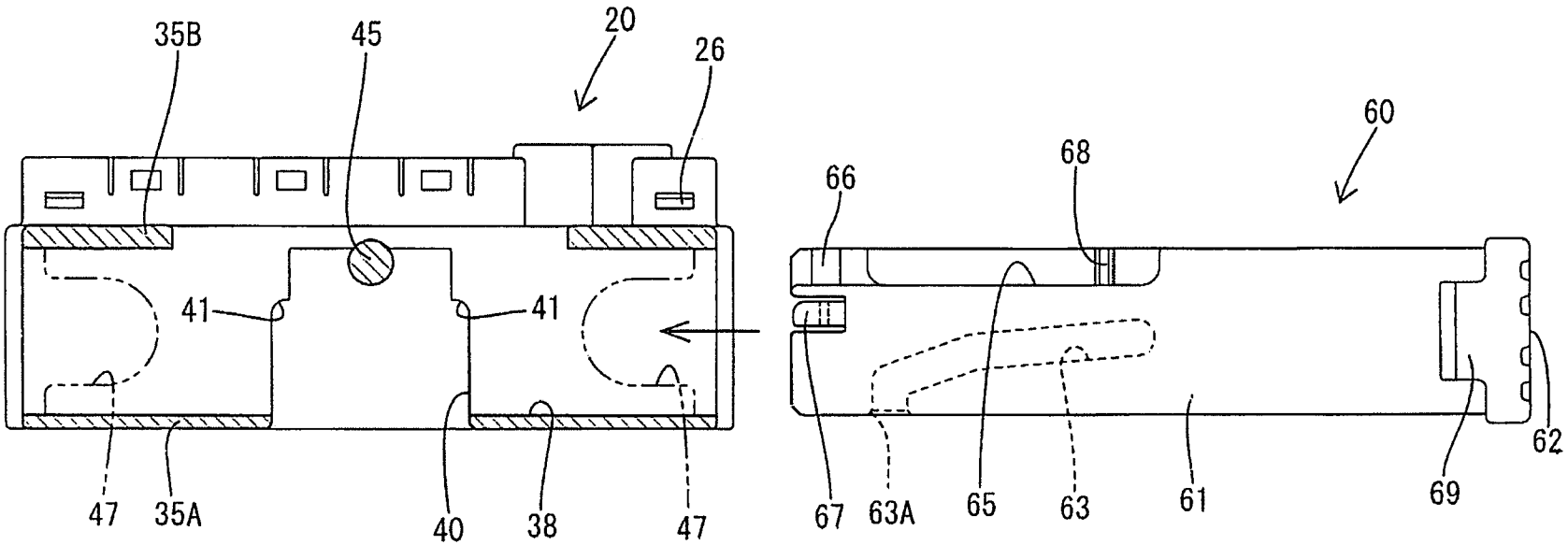
FIG. 11 is a plan view partly in section showing an operation of mounting a slide lever into the female housing.
Figure 13:
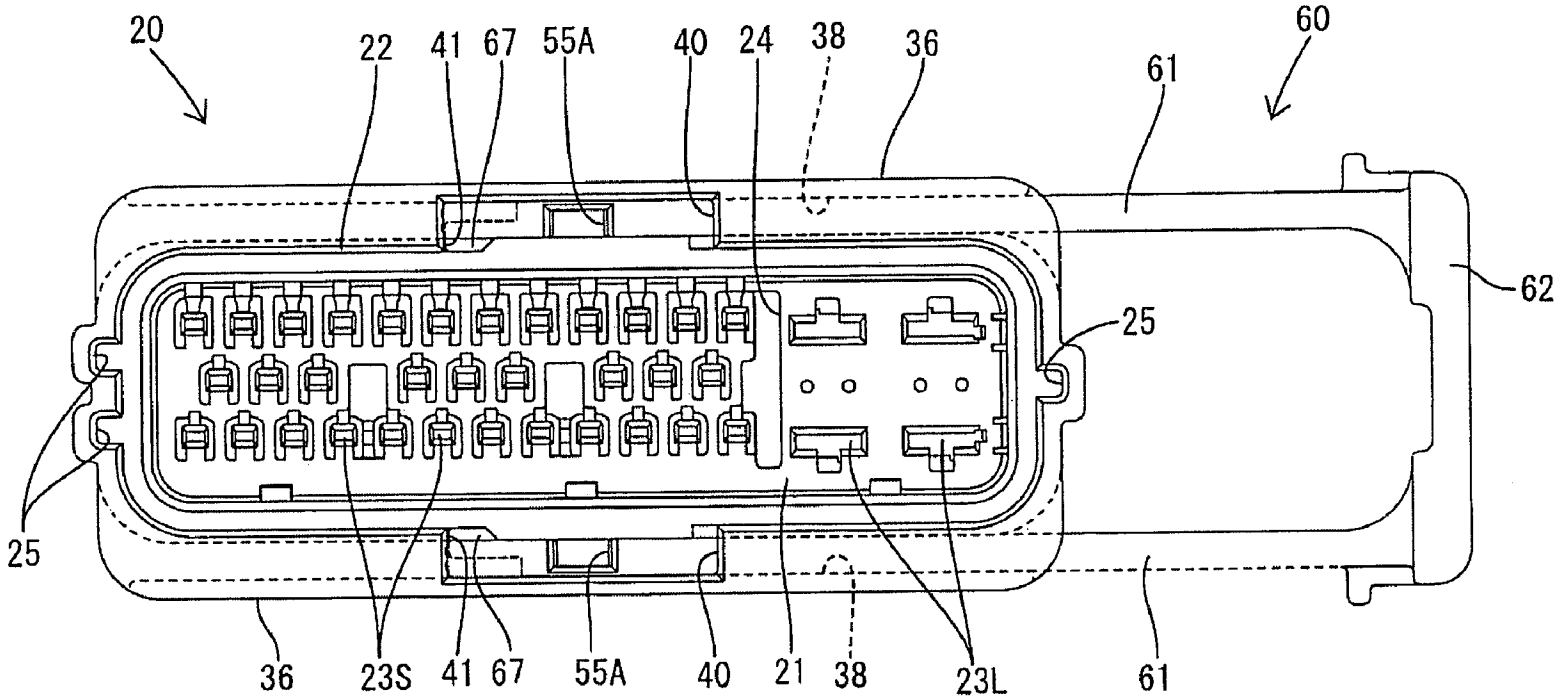
FIG. 13 is a front view of the female housing showing a state where the slide lever is mounted at an initial position.

The slide lever 60 is made unitarily e.g. of a synthetic resin and has two slidable plates 61 joined by an operable portion 62, as shown in FIGS. 11 and 13. Thus, the slide lever 60 is substantially gate-shaped. The slide lever 60 is mountable through either the left or right end surface by inserting both slidable plates 61 into the respective upper and lower insertion paths 38 of the female housing 20.

Cam grooves 63 are formed in the facing inner surfaces of the slidable plates 61. Each cam groove 63 extends from the front of the slidable plate 61 to a longitudinal intermediate position, and inclines towards the rear edge (upper edge in FIG. 11) at two inclinations. An entrance 63A of each cam groove 63 extends substantially at a right angle to the front edge of the slidable plate 61.

Figure 14:
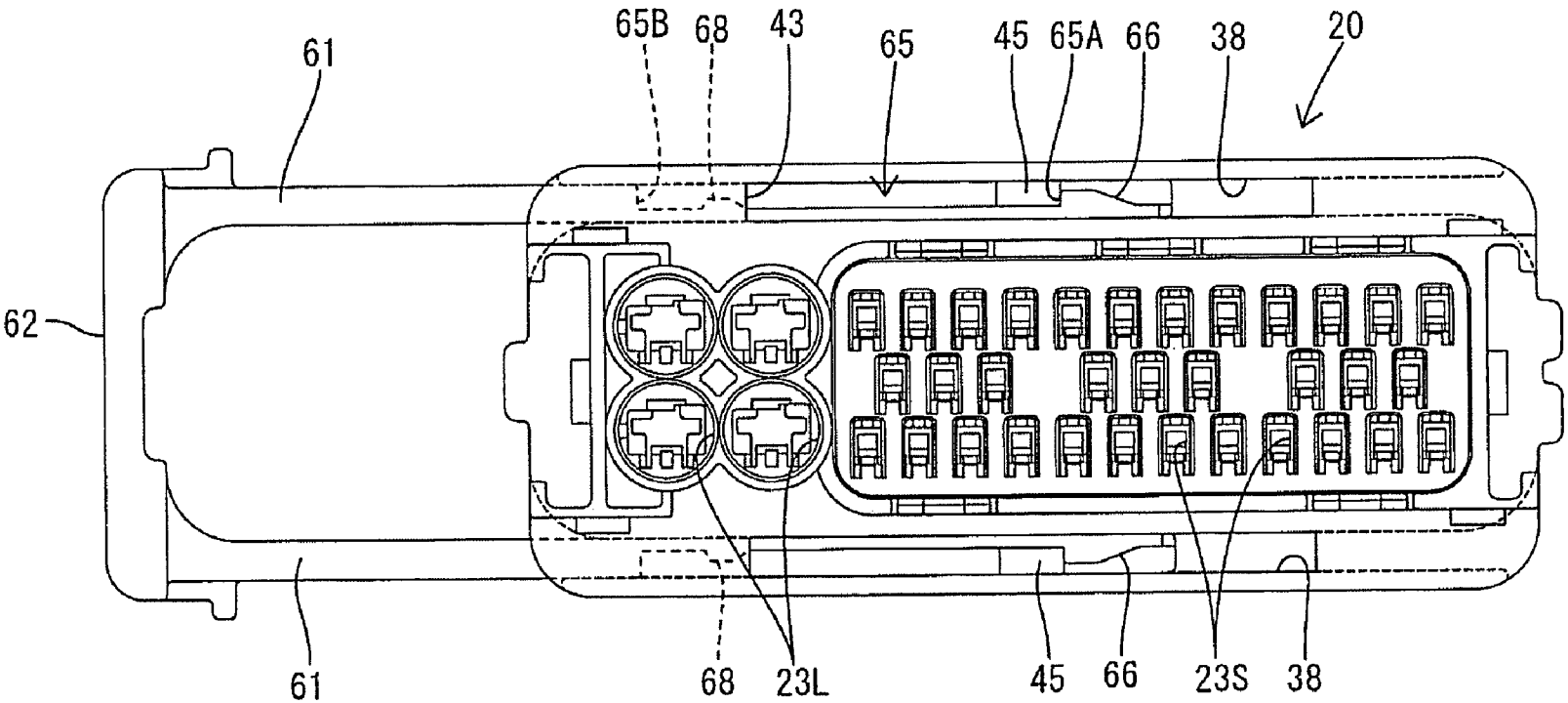
FIG. 14 is a rear view of the female housing showing the state where the slide lever is mounted at an initial position.

A guide groove 65 is formed at the back edge of the outer surface of each slidable plate 61 for slidably accommodating the projecting end of the shaft 45 for the rotary lever 50. The guide groove 65 extends from a position slightly receded from the leading end to the longitudinal center. Slanted guiding surfaces 66 are formed at the leading ends of the guide grooves 65, as shown in FIG. 14. The shafts 45 move onto the guiding surfaces 66 and then fit into the guide grooves 65 when the slidable plates 61 are inserted into the insertion paths 38. The slider 60 is assembled to move between an initial position SIP (see FIG. 12) and an end position SEP (see FIG. 17) by inserting the slider 60 more deeply into the female housing 20 while sliding the shafts 45 along the guide grooves 65.

Figure 12:
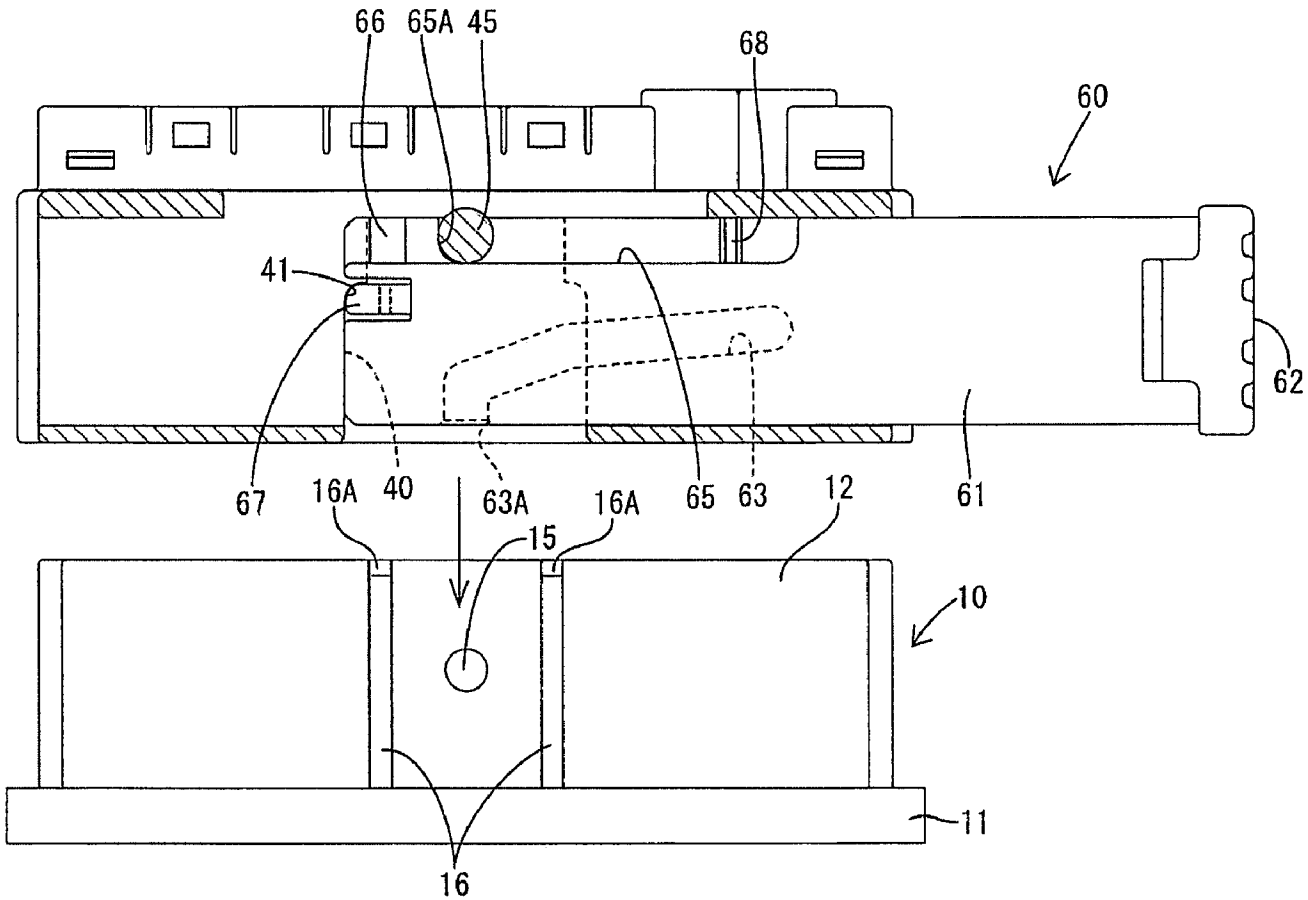
FIG. 12 is a plan view partly in section showing a state before the male and female housings are connected in the case of using the slide lever.

The shafts 45 contact front ends 65A of the guide grooves 65 at the initial position SIP, as shown in FIG. 12, to prevent movement in withdrawing direction. At this initial position SIP, the entrances 63A of the cam grooves 63 face forward substantially in the widthwise centers of the insertion grooves 40 for receiving the follower pins 15. A locking piece 67 faces forward along a moving direction at the leading end of each slidable plate 61 and at a side of the guiding surface 66. The locking piece 67 temporarily locks the slide lever 60 to prevent movement from the initial position SIP towards the end position SEP. Leading ends of the locking pieces 67 are rounded to conform to the locking steps 41 in the insertion grooves 40, and are resiliently deformable inward and outward relative to the plate surfaces. The locking pieces 67 normally project more inward than the inner surfaces of the slidable plates 61.

The locking pieces 67 engage the corresponding locking steps 41 when the slide lever 60 is at the initial position SIP to prevent the slide lever 60 from being pushed toward the end position SEP. The locking pieces 67 are located on the entrance paths for the unlocking ribs 16 on the mating male housing 10 at this time (see FIG. 15).

Figure 17:
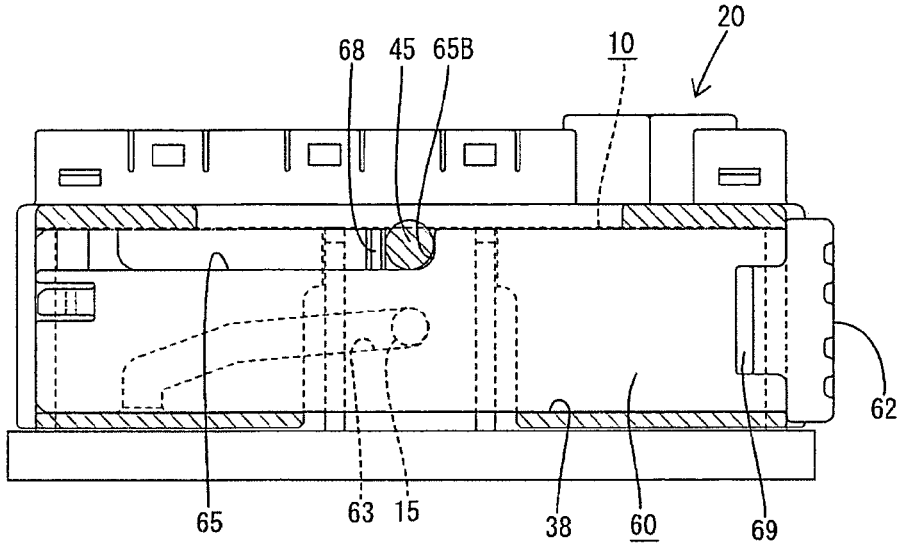
FIG. 17 is a plan view partly in section showing a state where the connection of the male and female housings is completed.
Figure 18:
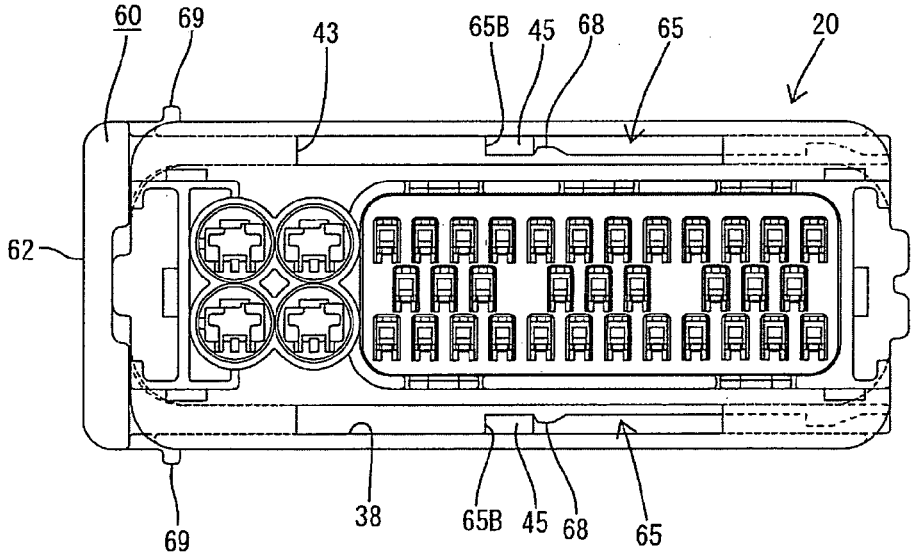
FIG. 18 is a rear view of the female housing showing the state where the connection of the male and female housings is completed.

The operable portion 62 contacts the left end surface of the female housing 20 when the slide lever 60 is pushed to the end position SEP. Simultaneously the rear ends 65B of the guide grooves 65 contact the shafts 45 to prevent the slide lever 60 from being pushed any further as shown in FIG. 17. Short triangular lock projections 68 are formed in the guide grooves 65 slightly before the rear ends 65B, as shown in FIG. 18, for locking the shafts 45 at the rear ends 65B of the guide grooves 65.

Holding grips 69 are formed at the base ends of the slidable plates 61 so that the slide lever 60 can be gripped from opposite sides and pulled back from the end position. Thus, the shafts 45 move over the lock projections 68. Windows 47 are formed at the opposite left and right ends of the covers 36 for exposing the grips 69 to the outside.

To use the rotary lever 50, the wire cover 30 is mounted on the rear surface of the female housing 20. The wire cover 30 is mounted with the open end surface 32 faced to left, as shown in FIG. 4, if the wires are to be guided out to the left. The rotary lever 50 then is mounted. The rotary lever 50 is accommodated in the accommodation spaces 44 and is supported by the shafts 45 so that the operable portion 53 faces to the right and is at the side of the escaping surface 31 of the wire cover 30. Thus, the rotary lever 50 is at the initial position LIP where the operable portion 53 contacts the rear surface of the female housing 20 at the right side.

At this initial position LIP, the entrances 55A of the cam grooves 55 face forward in substantially centers of the insertion grooves 40. Further, the locking pieces 57 engage the right locking steps 41 to lock the rotary lever 50 temporarily. Thus, the rotary lever 50 will not rotate inadvertently from the initial position LIP towards the end position LEP.

The female housing 20 can be connected with the mating male housing 10 in the connecting direction CD, as shown by an arrow in FIG. 4. The follower pins 15 of the male housing 10 enter the cam grooves 55 through the entrances 55A, as the connection progresses. Simultaneously, the unlocking ribs 16 enter the insertion grooves 40, as shown in FIG. 6, and the slanted surfaces 16A lift the locking pieces 57 towards the outer sides so that the right unlocking ribs 16 slip under the locking pieces 57. As a result, the locking pieces 57 move above the locking steps 41 to permit the rotary lever 50 to rotate.

The rotary lever 50 is rotated in counterclockwise direction of FIG. 6 by moving the operable portion 53. Thus, the follower pins 15 move towards the back ends the cam grooves 55 and a cam action between the follower pins 15 and the cam grooves 55 pulls the female housing 20 towards the male housing 10. The follower pins 15 reach the closed ends of the cam grooves 55 when the rotary lever 50 is rotated to the end position LEP, as shown in FIG. 8, and the two housings 10, 20 are connected properly. At this time, the lock piece 58 of the operable portion 53 engages the lock projection 34 of the wire cover 30 to prevent the rotary lever 50 from returning. Thus, the two housings 10, 20 are locked in their connected state. Accordingly, the connection of the female and male connector housings 20, 10 is performed or assisted by rotating the rotary lever 50.

The two housings 10, 20 may have to be separated for maintenance or other reason. Thus, the rotary lever 50 is urged back towards the initial position LIP. Initial forces on the rotary lever 50 cause the locking piece 58 to deform and disengage from the lock projection 34. The follower pins 15 then move in the cam grooves 55 and a cam action is exhibited to separate the two housings 10, 20 with a small operation force.

Figure 9:
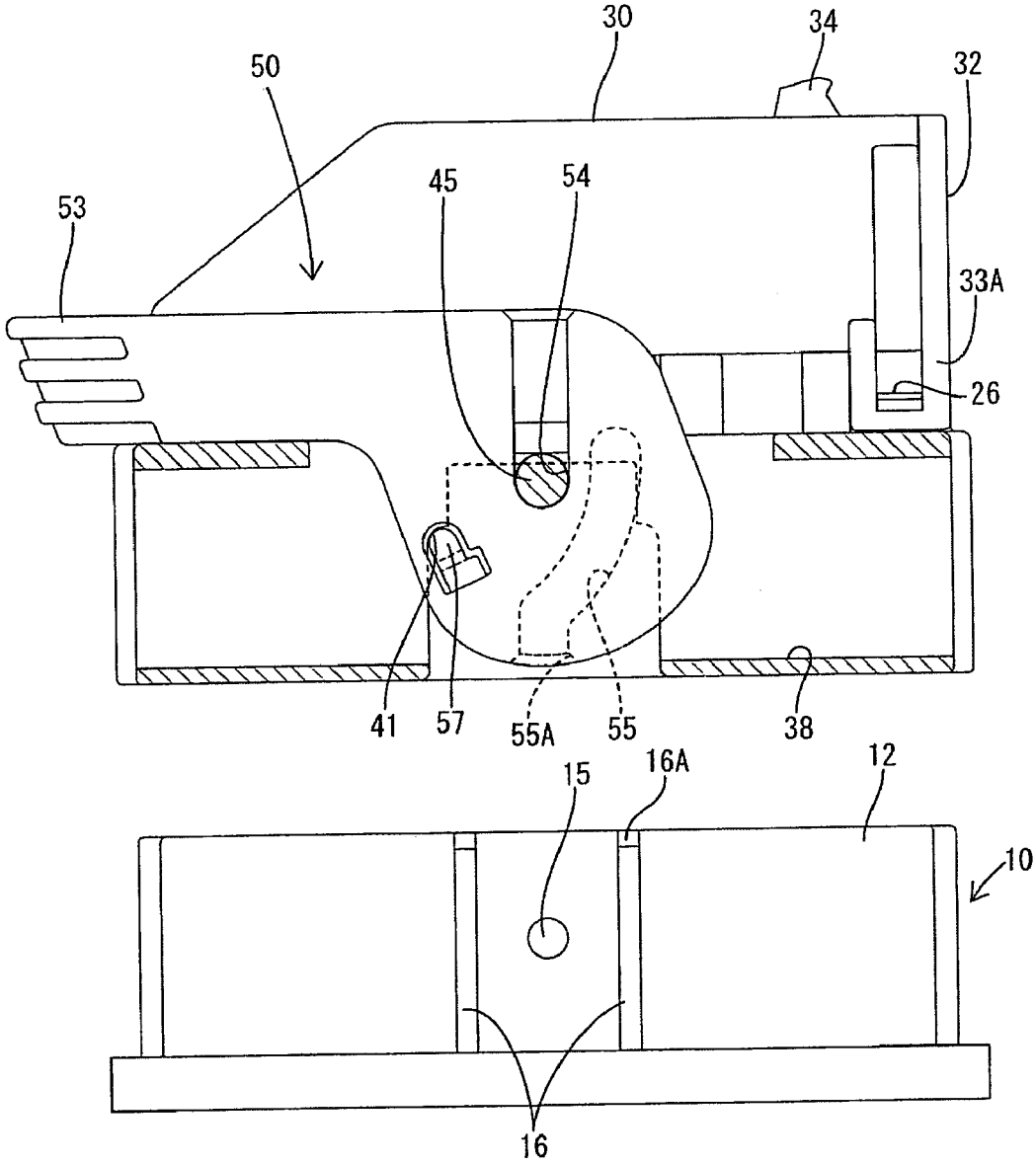
FIG. 9 is a plan view partly in section showing a case where the wire cover and the rotary lever are mounted in their symmetrically inverted postures.
Figure 10:
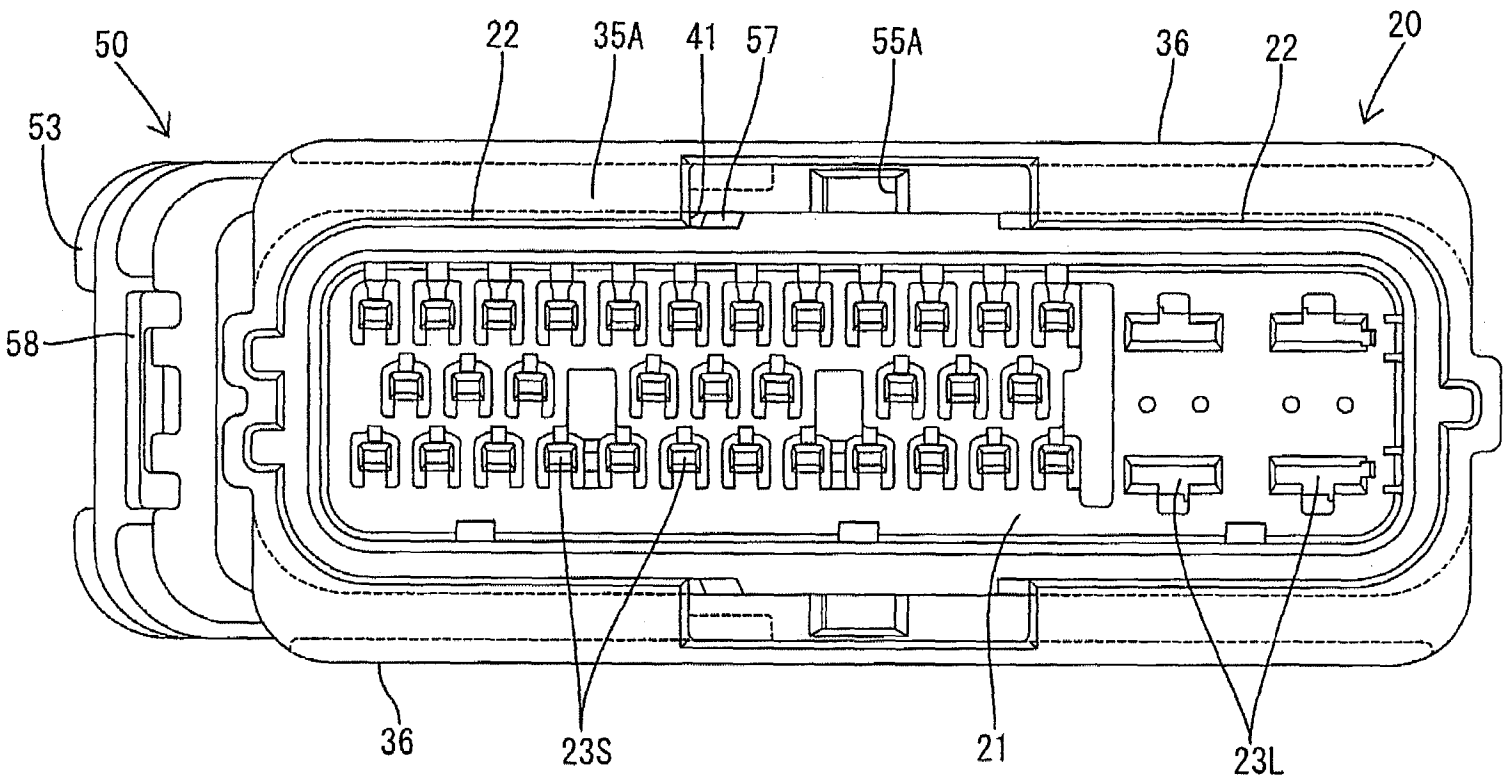
FIG. 10 is a front view of the female housing showing the case the wire cover and the rotary lever mounted in symmetrically inverted postures.

It may be necessary to guide the wires to right. Thus, the wire cover 30 is mounted so that the open end surface 32 faces right. The rotary lever 50 then is supported on the shafts 45 at the initial position LIP where the operable portion 53 faces to left as shown in FIGS. 9 and 10. At this time, the left locking steps 41 lock the rotary lever 50 temporarily at the initial position LIP.

The housings 10, 20 are connected and separated along the connecting direction CD with small operation forces due the lever or cam action with the follower pins 15 engaged in the cam grooves 55. However, the rotary lever 50 is rotated in the opposite direction.

The female housing also can use the slide lever 60. More particularly, the slide lever 60 is inserted into the insertion paths 38 of the female housing 20 from the right, as shown in FIG. 11, and is held at the initial position SIP, as shown in FIG. 12. At this initial position SIP, the entrances 63A of the cam grooves 63 face forward substantially in the centers of the insertion grooves 40. Further, the locking pieces 67 engage the left locking steps 41 to lock the slide lever 60 temporarily at the initial position SIP so that the slide lever 60 is not pushed inadvertently towards the end position SEP.

Figure 15:
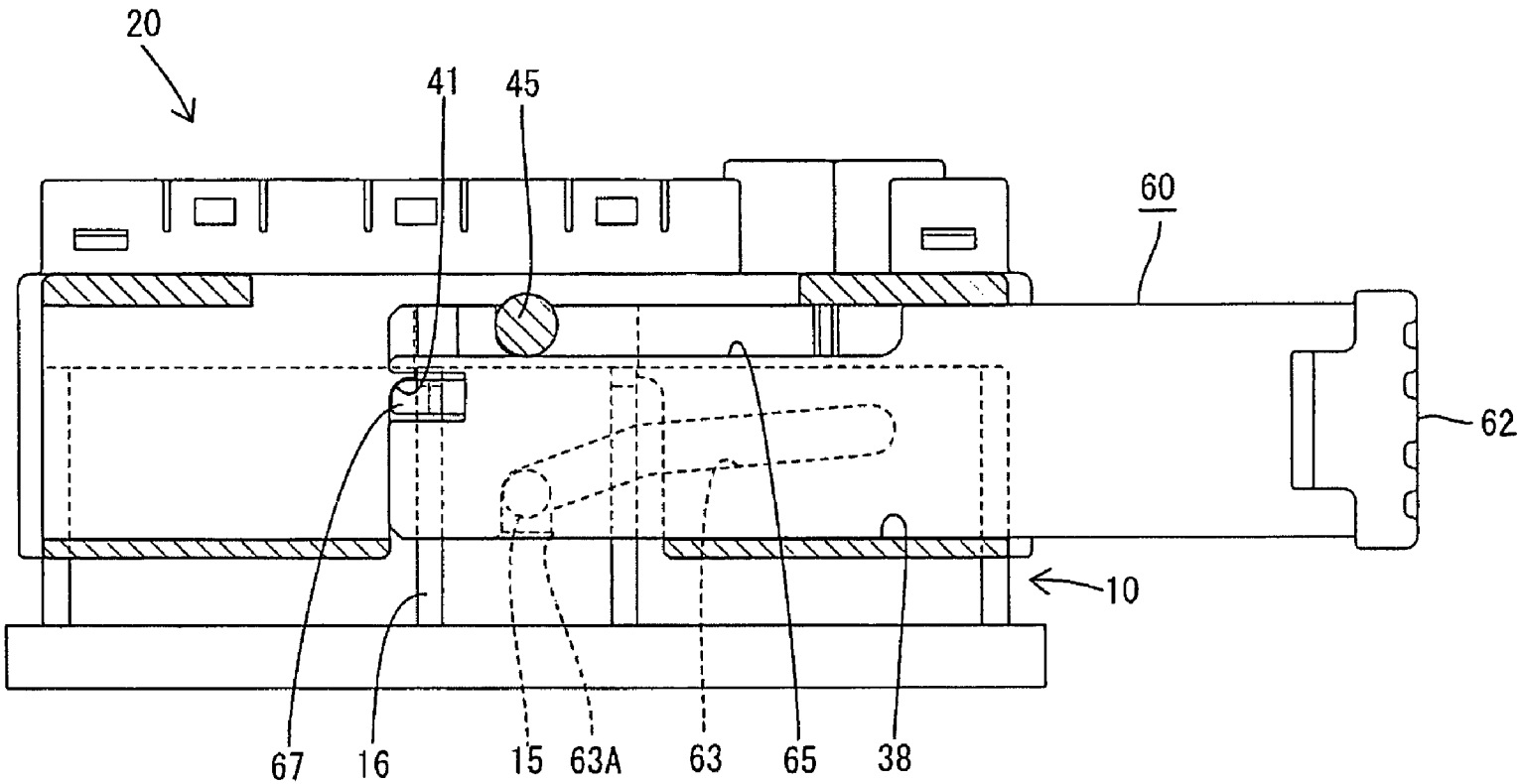
FIG. 15 is a plan view partly in section showing an initial stage of the connection of the male and female housings.
Figure 16:
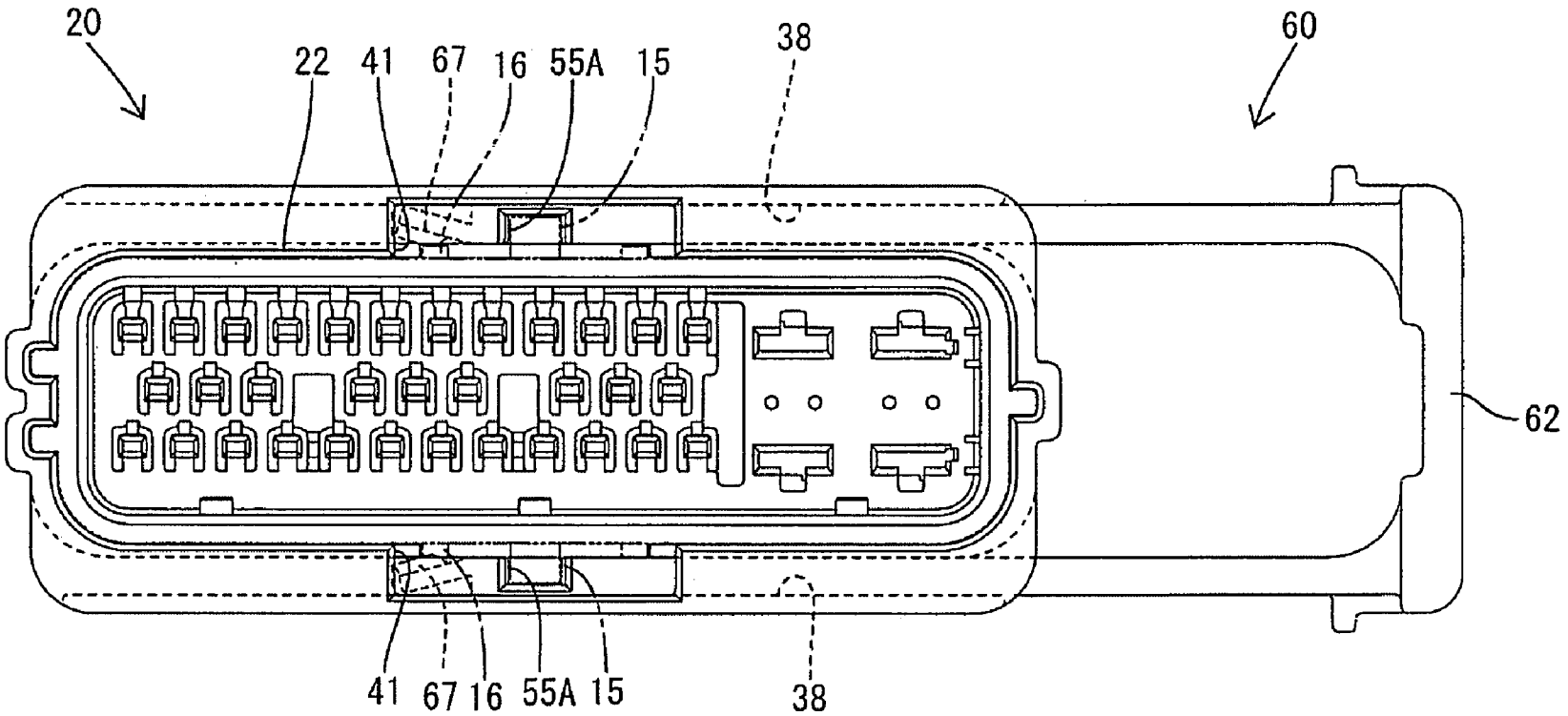
FIG. 16 is a front view of the female housing at the initial stage of the connection of the male and female housings.

The female housing 20 can be connected with the mating male housing 10, as shown by an arrow in FIG. 12. The follower pins 15 of the male housing 10 enter the cam grooves 63 through the entrances 63A as the connection progresses. Simultaneously, the unlocking ribs 16 enter the insertion grooves 40, as shown in FIG. 15. The slanted surfaces 16A lift the locking pieces 67 toward the outer sides so that the left unlocking ribs 16 slip under the locking pieces 67 to bring the locking pieces 67 above the locking steps 41. Thus, the slide lever 60 can be pushed.

The slide lever 60 can be pushed to the left side of FIG. 15 and towards the end position SEP by placing a hand on the operable portion 62. As a result, the follower pins 15 move towards the back ends of the cam grooves 63 and a cam action between the follower pins 15 and the cam grooves 63 pulls the female housing 20 towards the male housing 10. The follower pins 15 reach the closed ends of the cam grooves 63 when the slide lever 60 is pushed to the end position SEP, as shown in FIGS. 17 and 18. Thus, the two housings 10, 20 are connected properly. At this time, the shafts 45 move over the lock projections 68 and are locked at the rear ends 65B of the guide grooves 65. Accordingly, the slide lever 60 is locked at the end position SEP and the two housings 10, 20 are locked in their properly connected state.

The housings 10, 20 may have to be separated for maintenance or other reason. Thus, the grips 69 projecting through the windows 47 in the state of FIG. 17 are held and the slide lever 60 is moved to the right and towards the initial position SIP. The shafts 45 move over the lock projections 68 and the follower pins 15 move in the cam grooves 55 to generate a cam action. Thus, the housings 10, 20 can be separated with a small operation force.

Figure 19:
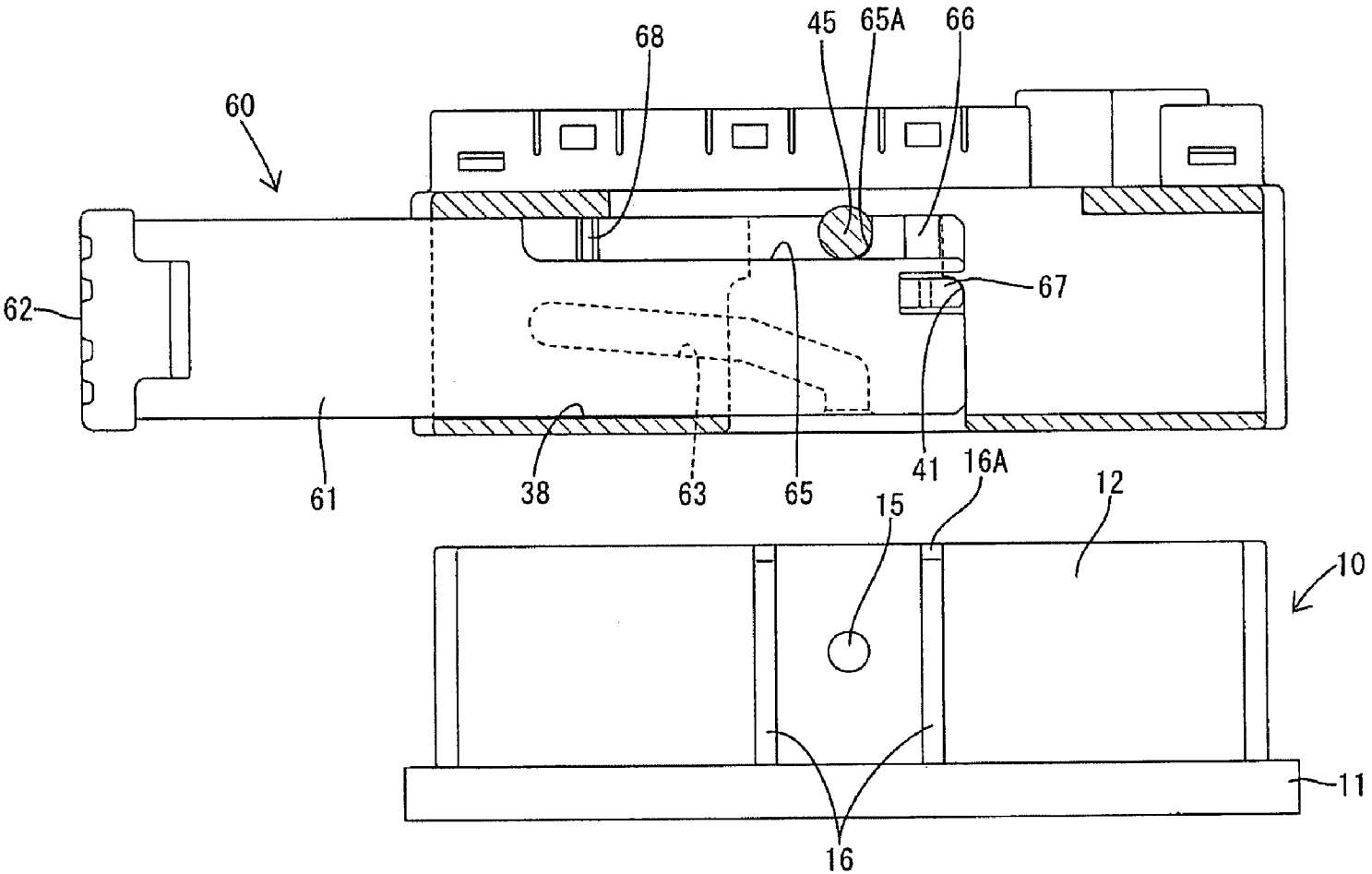
FIG. 19 is a plan view partly in section showing a case where the slide lever is mounted in its symmetrically inverted posture.
Figure 20:
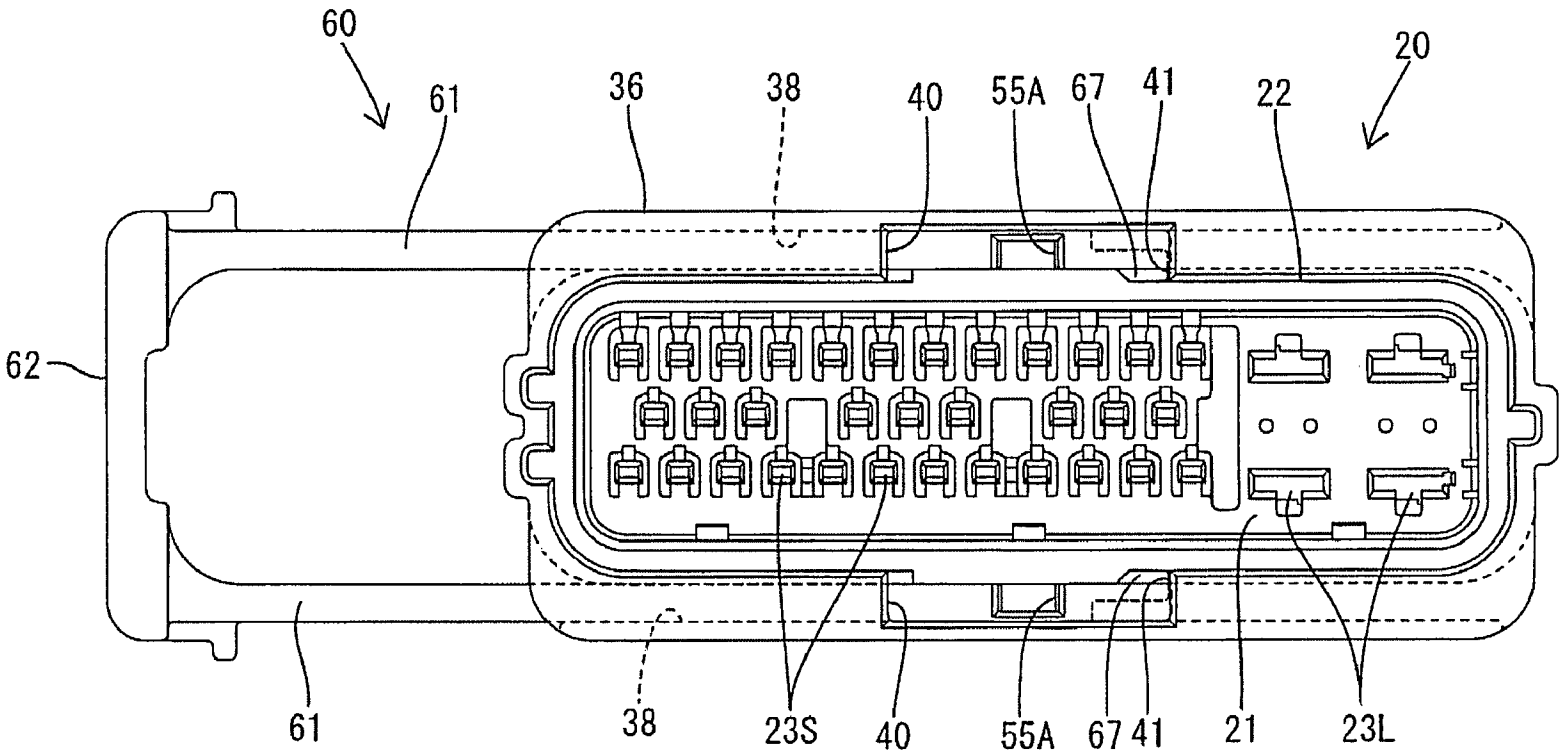
FIG. 20 is a front view of the female housing showing the case where the slide lever is mounted in its symmetrically inverted posture.

It may be necessary to insert and withdraw the slide lever 60 into and from the female housing 20 at left side when viewed from front because of an operation space. Thus, the slide lever 60 is inserted into the insertion paths 38 of the female housing 20 from left side and is held at the initial position SIP, as shown in FIGS. 19 and 20. Accordingly, the right locking steps 41 are used to lock the slide lever 60 temporarily at the initial position SIP.

The housings 10, 20 are connected and separated with low forces by the cam action from the cam grooves 63 and the follower pins 15. However, the moving directions of the slide lever 60 is opposite from the above case.

As described above, the rotary lever 50 and the slide lever 60 have different modes of displacements, but are selectively mountable on the same female housing 20. Additionally, both levers 50, 60 are mountable in transversely symmetric postures. Thus, four operation modes of levers can be selected. Therefore, the housings 10, 20 can be connected efficiently by selecting an optimal lever or cam operation mode if the operation space for the lever is restricted or the wire draw-out direction is specified. Further, both levers 50, 60 can be mounted on the same housing 20 to reduce production costs.

The locking steps 41 are used for locking both the rotary lever 50 and the slide lever 60 at their initial positions in both transversely symmetric postures. Thus, the construction of the female housing 20 can be simpler.

The shafts 45 to support the rotary lever 50 restrict the movable range of the slide lever 60 and locking the slide lever 60 at the end position. Thus, the construction of the female housing 20 can be even simpler.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Even in the case of using the slide lever, the wire cover may be mounted on the rear surface of the female housing to guide the wires out in a specified direction. In such a case, if the slide lever is mounted from the side opposite from the open end surface of the wire cover, it can be easily moved forward and backward.

Depending on the shape of the connector, the follower pins are provided on the female housing and the rotary lever or slide lever formed with the cam grooves may be provided on the male housing.

The present invention is not limited to application to connectors integral to apparatuses, and also applicable to wire-to-wire connectors.

The slider 60 performs a substantially linear movement. However, the invention is also applicable to any other slider having a non-linear movement path (e.g. bent, arcuate, inclined path, etc.).

What is claimed is:

1. A connector, comprising:

a housing connectable with a mating housing, the housing including at least one shaft and at least one insertion path;

a rotary lever rotatably mountable to the at least one shaft and being formed with at least one cam groove for engaging a follower pin on the mating housing; and a slide lever slidably mountable in the at least one insertion path and being formed with at least one cam groove for engaging the follower pin on the mating housing, whereby one of the rotary lever and the slide lever is selectively mounted on the housing and is movable on the housing while engaging the follower pin of the mating housing for urging the housing and the mating housing into connection with one another.

2. The connector of claim 1, wherein the rotary lever is configured for selective mounting in either of first and second orientations symmetrically disposed with respect to the at least one shaft.

3. The connector of claim 1, wherein the slide lever is configured for selective mounting in either of first and second orientations symmetrically from opposite ends of the insertion path.

4. The connector of claim 1, wherein the shaft for the rotary lever is configured for locking the slide lever at an end position.

5. The connector of claim 1, wherein the slide lever comprises at least one guide groove disposed and configured for receiving the shafts during movement of the slide lever towards an end position.

6. The connector of claim 5, wherein leading ends of the guide grooves have slanted guiding surfaces configured for guiding the shafts into the guide grooves as the slide lever moves towards the end position.

7. A connector assembly comprising the connector of claim 1 and a mating connector connectable therewith along a connecting direction.

8. The connector of claim 1, wherein the rotary lever and the slide lever include engaging means for releasable engagement with at least one lock on the housing and releasably locking the rotary lever or the slide lever at an initial position where the cam groove is aligned to receive the follower pin.

9. The connector of claim 8, wherein the lock is configured to engage the engaging portions of either of the rotary lever and the slide lever.

10. The connector of claim 8, wherein the at least one lock includes a plurality of locks symmetrically arranged with respect to the shaft.

11. The connector of claim 1, further comprising a wire cover mountable on a rear surface of the housing for at least partly accommodating wires drawn out from the housing and guiding the wires in a specified direction.

12. The connector of claim 11, wherein the wire cover is selectively mountable in either of two symmetric positions on the housing.

* * * * *